United States Patent [19]

Conway et al.

[11] Patent Number: 5,077,101

[45] Date of Patent: Dec. 31, 1991

[54] THREE COLOR INFRARED CAMOUFLAGE SYSTEM

[75] Inventors: Thomas G. Conway, Woodbridge; Robin-Lynn G. McClean, Warrenton; Grayson W. Walker, Alexandria, all of Va.

[73] Assignee: The United States of America as represented by the Secretary of the Army, Washington, D.C.

[21] Appl. No.: 401,692

[22] Filed: Sep. 1, 1989

[51] Int. Cl.[5] ..... F41H 3/00

[52] U.S. Cl. ..... 428/17; 156/61; 156/63; 428/919

[58] Field of Search ..... 428/919, 15, 17; 156/61, 63, 299

[56] References Cited

U.S. PATENT DOCUMENTS

| | | | |
|---|---|---|---|
| 2,294,675 | 9/1942 | MacMillin et al. | 72/312 |
| 2,294,875 | 9/1942 | Hexter et al. | 428/919 X |
| 2,741,824 | 4/1956 | Robbins II et al. | 428/919 X |
| 4,142,015 | 2/1980 | Bienz | 428/919 X |
| 4,308,882 | 1/1982 | Pusch et al. | 428/919 X |
| 4,495,239 | 1/1985 | Pusch et al. | 428/919 X |
| 4,529,633 | 7/1985 | Karlsson | 428/919 X |
| 4,560,595 | 12/1985 | Johansson | 428/919 X |
| 4,615,921 | 10/1986 | Johansson | 428/919 X |
| 4,656,065 | 4/1987 | Yacovella | 428/919 X |
| 4,865,900 | 9/1989 | Shannon et al. | 428/17 X |
| 4,868,019 | 9/1989 | Knickerbocker | 156/61 X |

*Primary Examiner*—Henry F. Epstein

*Attorney, Agent, or Firm*—Anthony T. Lane; Werten F. W. Bellamy; Charles D. Miller

[57] ABSTRACT

A three-color camouflage system comprises layers of camouflage material having low, intermediate and high thermal emissivities in the infrared spectral range, and appearing black, green and brown in the visible spectral range. The camouflage surface is structured in such manner that there is color adaptation to the natural background in the visible spectral range, as well as adaptation to the natural background in thermal emissivity in the infrared spectral range so that targets cannot be recognized with infrared sensing devices. Thermal emissivity in the infrared spectral range is controlled by superimposing layers of intermediate and high emissivity onto a basic low emissivity camouflage layer and providing perforations in these layers allowing the low-emissivity layer to be seen. High-emissivity areas are provided by perforations allowing the high-emissivity surface of the object being camouflaged to be seen. Alternatively, spots of high emissivity are superimposed on the three camouflage layers to provide areas of high emissivity. This camouflage system may also be used in the construction of decoys.

26 Claims, 1 Drawing Sheet

THREE COLOR INFRARED CAMOUFLAGE SYSTEM

GOVERNMENT INTEREST

The invention described herein may be manufactured and used by or for the United States Government for Governmental purposes without the payment of any royalties and is being assigned to the United States Government.

BACKGROUND OF THE INVENTION

1. Field of Invention

This invention relates to camouflaging means and a method for disguising the visible and infrared image of military targets which may be substantially warmer than their surroundings by having been exposed to the sun, or in which heat may be produced by internal combustion engines, electric motors, generators, or transformers.

2. Description of Prior Art

Camouflage materials providing protection in the visible spectral region (wavelength from 400–700 millimicrons) by color adaptation to the background are well known to the art. However, most currently used camouflage paints, irrespective of their color in the visible spectral region, tend to have high emissivities in the infrared spectral regions from 3 to 5 and from 8 to 14 microns. (No significant infrared radiation is propagated over long distances outside these two "windows" because of absorption by water vapor and carbon dioxide contained in the atmosphere.)

The emissivities of such paints tend, on average, to be significantly higher than those of most naturally occurring backgrounds. Therefore, targets painted with such paints can be clearly detected by imaging devices operating in the infrared spectral ranges. Moreover, many such targets have heat sources such as internal combustion engines, electric generators and motors which create a temperature contrast with the natural background which further enhance the detectability of such targets by means of infrared sensing devices. To provide protection against sensing devices operating in the infrared spectral regions, camouflaging materials with controlled electromagnetic emissivities in the infrared regions as well as in the near-by radar region have been proposed.

U.S. Pat. Nos. 4,560,595 and 4,615,921 provide a thin metallic randomly deformed camouflage layer covered by two different plastic materials having different emissivities in the infrared region, simulating the surrounding terrain. U.S. Pat. No. 4,495,239 provides camouflage nets and thermal insulation mats using pigments for the visible and near infrared spectral region, and a binder with high transparency to radiation in the infrared range, providing low emissivity in that range, as well as in the radar range from 3 to 3000 GHz. U.S. Pat. No. 4,142,015 provides a layer of insulating foamed plastic, applied to the surface of the target to be camouflaged, that varies randomly to blur the visual and thermal image of the target. U.S. Pat. No. 2,294,675 provides a coating composition having a dark color in the visible spectral range and a low emissivity in the infrared range.

The methods and apparatus provided heretofore for disguising military targets both in the visible and infrared spectral ranges suffer from the drawback that the effective emissivity of the camouflage material in the infrared ranges cannot readily be closely adapted to that of the surroundings from which the target should be indistinguishable when viewed by infrared detection equipment. Moreover, the thermal "signature" of such targets resulting from internal heat sources such as internal combustion engines, exhaust pipes, electric motors or generators, or transformers, cannot readily be disguised by known methods.

The object of present invention therefore is to provide means and a method for structuring the camouflaging surface in such manner that there is both color adaptation in the visual range and an effective emissivity in the infrared range which can be designed to simulate that of virtually any natural background, and which can furthermore be designed to disguise hot regions of the target which would ordinarily be clearly discernible with infrared detection devices.

SUMMARY OF THE INVENTION

The present invention provides camouflaging means fastened to the surface of a military target to be camouflaged which includes a material having a high emissivity (0.7–0.9) in the visible spectral range, thus appearing black to the human eye, and a low emissivity (about 0.1) in the infrared spectral range; a second material superimposed upon the first material in irregularly-shaped patches which appears green in the visible spectral range and which has an intermediate emissivity (0.5–0.7) in the infrared spectral range; and a third material superimposed upon the first material in irregularly-shaped patches which appears brown in the visible spectral range and which has a high emissivity (0.7–0.9) in the infrared spectral range. The irregularly-shaped patterns thus created on the camouflaging surface are designed to simulate naturally occurring backgrounds. For equipment of the United States Army, the patterns are in accordance with Technical Manual 43-0139, "Painting Instructions for Army Materiel," Troop Support Command (TROSCOM) Publications. The proportions are 44% green, 41% black and 15% brown.

The camouflaging layers are attached to the surface of the equipment and to each other by adhesives.

Perforations in the green and brown patches allow portions of the black material to be seen. Additional perforations through the black, green and brown materials allow thermal radiation from the equipment being camouflaged to pass through to the surroundings. In an alternative embodiment of this invention, small spots of material having high emissivity in the infrared range are applied to the camouflaging surface in place of the additional perforations.

As a further alternative, brown and green camouflage layers may be applied to the target surface and black camouflage material may be superimposed in continuous, randomly-shaped patches, or in small spots by a sputtering technique.

The technique of this invention by which both the visible and infrared appearance of an object can be controlled may also be used in the construction of two-dimensional and three-dimensional decoys simulating military and other targets.

DESCRIPTION OF PREFERRED EMBODIMENTS OF THE INVENTION

Figure 1:
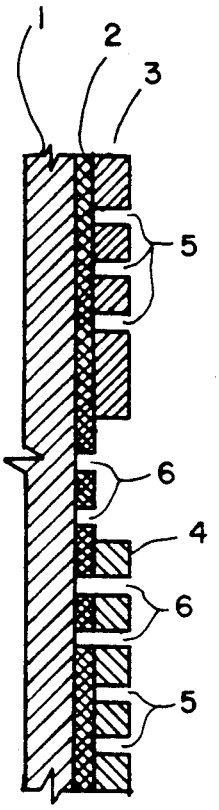
FIG. 1 illustrates schematically, in cross section, the layers of camouflaging material applied to the surface of the equipment to be camouflaged.

The camouflaging means of this invention provides conventional color adaptation in the visible spectral range. Irregularly-shaped black, green and brown patterns mimic foliage and soils. For equipment of the United States Army, the patterns are in accordance with Technical Manual 43-0139, "Painting Instructions for Army Materiel," Troop Support Command (TROSCOM) Publications. The proportions are 44% green, 41% black and 15% brown. Other color combinations may be chosen to mimic desert and snowy environments.

In the infrared spectral regions from 3 to 5 and from 8 to 14 microns of wavelength, the emissivity of the camouflaging surface is controlled by mixing low-emissivity areas with high-emissivity areas, whereby a wide range of average emissivity may be achieved by the suitable choice of area ratios. The average emissivities of the camouflaging means in the infrared spectral regions are chosen to correspond to emissivities in the same spectral regions found in the natural environments in which the camouflaged targets will operate.

The basic camouflage material used in this invention is a layer having a high emissivity (0.7–0.9) in the visible spectral range, thus appearing black to the human eye, and a low emissivity in the infrared spectral ranges (about 0.1). Nickel oxide and black stainless steel are most suitable for this purpose; such materials are commercially available. This layer is bonded to the surface of the equipment by adhesives.

Superimposed on this first basic layer are additional layers, such as fabric patches of irregular shape being dyed or pigmented to appear green and brown in the visible spectral region and having intermediate to high emissivities in the infrared spectral regions. These green and brown layers are bonded to the base layer by adhesives.

The darkness or brightness of these green and brown fabric patches in the visible spectral range may be varied by providing small perforations, regularly or randomly spaced, through which the visually black underlying surface may be seen. The human eye, rather than perceiving these small black spots as such, mixes them and perceives them as different shades of dark and light green and brown. The size of these perforations may range from 1 to 3600 square millimeters each, and the area occupied by these perforations in any given section of camouflage surface may range from 1 to 25 percent of the total area.

An analogous kind of mixing of dark and light takes place in the infrared spectral regions. The small perforations in the green and brown layers permit the low-emissivity base layer to be seen. The effect is to lower the effective average emissivity in any given region of the camouflage surface to a level between that of the intermediate-to-high values of the unperforated layers and that of the low-emissivity base layer.

An additional method of varying the average effective emissivity of the green and brown layers, as well as that of the black base layer, consists of providing spots of high emissivity. This is accomplished by two alternate means:

(a) small perforations through the camouflaging layers are provided which are too small to see individually on infrared imaging equipment but which allow radiation from the target surface, which has a high emissivity in the infrared range, to pass through all the camouflage layers, creating local regions of higher average emissivity;

(b) small spots of high emissivity, e.g. spots of epoxy paint, are applied to the camouflaging layers, these spots again being too small to be perceived as individual spots on infrared sensing equipment but conferring on the local area a higher average emissivity which is perceptible to infrared sensors. The color of these spots in the visible spectral range should preferably be green or brown.

The perforations and spots of high emissivity may again range from 1 to 3600 square millimeters each and have areas in any given section of the camouflaging surface ranging from 1 to 25 percent of the total area.

The variations in local average emissivity created by the methods described disrupt what otherwise would be perceived by infrared imaging devices as a conspicuously uniform object in a natural background having random variations in infrared radiation intensity. Hotspots on the target, such as diesel engines, exhaust pipes, motors, generators, and transformers, which would normally be detected by infrared sensors as areas of high infrared radiation, are camouflaged with the basic low-emissivity layer, perforations or spots of high emissivity being purposely omitted to maintain a low average emissivity.

Referring to FIG. 1 of the drawings, there is shown in schematic form a cross section of the camouflaging layers. Bonded to the surface of the target 1 is a thin layer 2 having high emissivity (0.7–0.9) in the visible spectral range and low emissivity in the infrared spectral region (about 0.1). Superimposed on this base layer are layers of a second camouflaging material 3 and a third camouflaging material 4, appearing green and brown, respectively, in the visible spectral region. Perforations 5 in the green camouflaging layer 3 allows the base layer 2 to be seen. Similar perforations are provided in the brown camouflaging layer 4. A second type of perforation 6 allows the surface of the target 1 to be seen.

Figure 2:
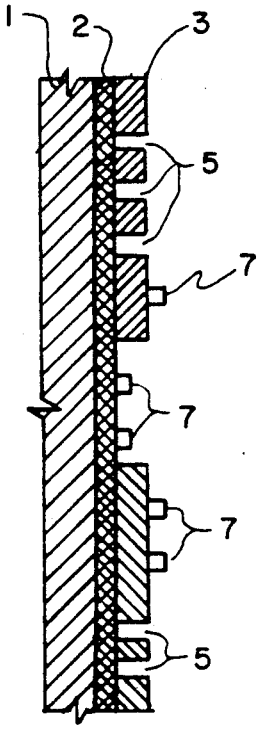
FIG. 2 illustrates an alternative embodiment of the invention.

FIG. 2 illustrates an alternate embodiment of the invention in which, instead of the second type of perforation, spots 7 of high-emissivity material, such as epoxy paint, are applied to the camouflaging surface.

Figure 3B:
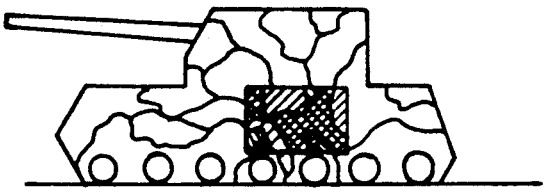
FIGS. 3A and 3B illustrate a typical frontal view of a camouflaged surface.
Figure 3A:
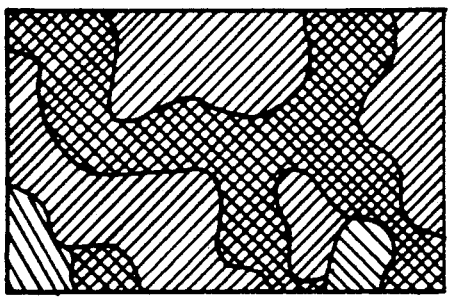

FIGS. 3A and 3B illustrate a typical view of a camouflaged surface. For equipment of the United States Army, the patterns are in accordance with Technical Manual 43-0139, "Painting Instructions for Army Materiel," Troop Support Command (TROSCOM) Publications. The proportions are 44% green, 41% black and 15% brown.

The control of emissivity in the infrared spectral range by means of performations and high-emissivity spots as used in this invention is illustrated by the following numerical examples.

EXAMPLE 1

A portion of a brown layer having an emissivity of 0.8 in the infrared spectral range has regularly spaced circular perforations 2 mm in diameter (about 3 sq. mm. area) which constitute 20% of the area and through which the low-emissivity base layer (emissivity 0.1)

may be seen. The average emissivity in this area is $0.8\times80\%+0.1\times20\%=0.66$.

EXAMPLE 2

A portion of a green layer having an emissivity of 0.5 has 2 mm diameter regularly spaced circular perforations through which the equipment surface (emissivity 0.95) may be seen. The perforations constitute 25% of the total area. The average emissivity is $0.5\times75\%+0.95\times25\%=0.61$.

EXAMPLE 3

A portion of the black base layer having an emissivity of 0.1 in the infrared spectral range has circular 3 mm diameter spots of high emissivity paint (emissivity 0.95) constituting 20% of the area. The average emissivity is $0.1\times80\%+0.95\times20\%=0.27$. The color of the spots in the visible spectral range is green.

EXAMPLE 4

A portion of a green layer (emissivity 0.5) has circular 2 mm diameter spots of high-emissivity paint (emissivity 0.95) representing 15% of the area. The average emissivity is $0.5\times85\%+0.95\times15\%=0.57$. The color of the spots in the visible spectral range is green.

It is thus apparent that by the appropriate choice of perforations and high-emissivity spots, the emissivity of the camouflage surface in the infrared spectral range can be varied to simulate the infrared emissivity patterns of naturally occurring backgrounds.

High-temperature parts of the target such as exhaust pipes, which would normally be observed as high-emissivity regions of a target by infrared sensing devices, can be "toned down" by the choice of low-emissivity camouflage layers which make such high-temperature parts blend in with the background.

As a further alternative, brown and green camouflage layers may be applied to the target surface and black camouflage material may be superimposed in continuous, randomly-shaped patches, or in small spots by a sputtering technique.

The technique of this invention by which both the visible and infrared appearance of an object can be controlled may also be used in the construction of two-dimensional and three-dimensional decoys simulating military and other targets.

While there have been described what at present are considered to be the preferred embodiments of this invention, it will be obvious to those skilled in the art that various changes and modifications may be made therein without departing from the invention and it is therefore intended to cover all such modifications and changes as fall within the spirit and scope of this invention.

What is claimed is:

1. Camouflaging means for disguising the visible and infrared image of a target, bonded to the surface of said target, comprising a first camouflaging layer having a low emissivity in the infrared spectral regions from 3 to 5 and 8 to 14 microns and a high emissivity in the visible spectral region from 400 to 700 millimicrons, thus appearing black to the human eye;

a second camouflaging layer having an intermediate emissivity in the infrared spectral regions and appearing green to the human eye in the visible spectral region, said second camouflaging layer bonded to said first layer in irregularly-shaped patches;

a third camouflaging layer having a high emissivity in the infrared spectral regions and appearing brown to the human eye in the visible spectral region, said third camouflaging layer being bonded to said first layer in irregularly-shaped patches;

a plurality of small perforations in said second and third camouflaging layers allowing the underlying surface of said first camouflaging layer to be seen;

whereby the effective average emissivity of said second and third layers may be varied to simulate a naturally occurring background.

2. Camouflaging means of claim 1 in which the emissivity of said first camouflaging layer is less than 0.45 in the infrared spectral region from 3 to 14 microns.

3. Camouflaging means of claim 1 in which the emissivity of said first camouflaging layer is greater than 0.7 in the visible spectral region from 400 to 700 millimicrons.

4. Camouflaging means of claim 1 in which the first camouflaging layer is made of nickel oxide.

5. Camouflaging means of claim 1 in which the second camouflaging layer consists of fabric patches bonded to said first camouflaging layer, having green pigment and having an intermediate emissivity in the infrared spectral region.

6. Camouflaging means of claim 1 in which the third camouflaging layer consists of fabric patches bonded to said first camouflaging layer, having brown pigment and having a high emissivity in the infrared spectral region.

7. Camouflaging means of claim 1 in which said perforations in said second and third camouflaging layers range from 1 to 3600 square millimeters in area each.

8. Camouflaging means of claim 1 in which said perforations in said second and third camouflaging layers occupy from 1 to 25 percent of the areas of said second and third layers.

9. Camouflaging means of claim 1 further comprising a plurality of second performations through said first, second and third layers, allowing portions of the surface of the target to be seen, said second perforations ranging from 1 to 3600 square millimeters in area each.

10. Camouflaging means of claim 9 in which said second perforations occupy from 1 to 25 percent of the area of said first, second and third layers.

11. Camouflaging means of claim 1 further comprising a plurality of spots of high emissivity bonded to said first, second and third layers, said spots ranging from 1 to 3600 square millimeters in area each.

12. Camouflaging means of claim 11 in which the spots of high emissivity consist of epoxy paint.

13. Camouflaging means of claim 11 in which the spots of high emissivity occupy from 1 to 25 percent of the area of said first, second and third layers.

14. A method of camouflaging a target against detection in the visible and infrared spectral ranges comprising 3 camouflage layers by:

bonding to the surface of the target a first camouflaging layer having a low emissivity in the infrared spectral regions from 3 to 5 and 8 to 14 microns and a high emissivity in the visible spectral region from 400 to 700 millimicrons, thus appearing black to the human eye;

bonding to the first camouflaging layer a second camouflaging layer having an intermediate emissivity in the infrared spectral regions and appearing green to the human eye, and being in the form of irregularly-shaped patches;

bonding to the first camouflaging layer a third camouflaging layer having a high emissivity in the infrared spectral regions and appearing brown to the human eye, and being in the form of irregularly-shaped patches, adjusting the darkness or brightness of the said second camouflaging layer in both the visible and infrared spectral regions by omitting selective portions of the second layer thereby exposing the surface of the said first camouflaging layer.

15. A method of camouflaging a target in accordance with claim 14 in which the emissivity of said first camouflaging layer is less than 0.45 in the infrared spectral region from 3 to 14 microns.

16. A method of camouflaging a target in accordance with claim 14 in which the emissivity of said first camouflaging layer is greater than 0.7 in the visible spectral region.

17. A method of camouflaging a target in accordance with claim 14 in which the first camouflaging layer is made of nickel oxide.

18. A method of camouflaging a target in accordance with claim 14 in which the second camouflaging layer consists of fabric patches bonded to said first camouflaging layer, having green pigment and having an intermediate emissivity in the infrared spectral region.

19. A method of camouflaging a target in accordance with claim 14 in which the third camouflaging layer consists of fabric patches bonded to said first camouflaging layer, having brown pigment and having a high emissivity in the infrared spectral region.

20. A method of camouflaging a target in accordance with claim 14 further characterized by a plurality of small perforations in said second and third camouflaging layers allowing the underlying surface of said first camouflaging layer to be seen, whereby the effective average emissivity of said second and third layers may be varied to simulate a naturally occurring background.

21. A method of camouflaging a target in accordance with claim 14 further characterized by a plurality of small perforations in said first, second and third camouflaging layers allowing the underlying surface of the target to be seen.

22. A method of camouflaging a target in accordance with claim 14 further characterized by a plurality of spots of high emissivity bonded to said first, second and third camouflaging layers.

23. A method of camouflaging a target in accordance with claim 20 in which the perforations range from 1 to 3600 square millimeters in area each, and occupy from 1 to 25 percent of the area of the second and third camouflaging layer.

24. A method of camouflaging a target in accordance with claim 21 in which the perforations range from 1 to 3600 square millimeters in area each, and occupy from 1 to 25 percent of the area of the first, second and third camouflaging layer.

25. A method of camouflaging a target in accordance with claim 22 in which the spots of high emissivity range from 1 to 3600 square millimeters in area each, and occupy from 1 to 25 percent of the area of the first, second and third camouflaging layer.

26. A method of camouflaging a target in accordance with claim 22 in which the spots of high emissivity consist of epoxy paint.

* * * * *